US006206255B1

(12) United States Patent
Turner

(10) Patent No.: US 6,206,255 B1
(45) Date of Patent: Mar. 27, 2001

(54) CLOTHES HANGER ADAPTER

(76) Inventor: Woody Turner, 8635 Sunset Blvd., W. Los Angeles, CA (US) 90069

( * ) Notice: Subject to any disclaimer, the term of this patent is extended or adjusted under 35 U.S.C. 154(b) by 0 days.

(21) Appl. No.: 09/427,016

(22) Filed: Oct. 25, 1999

Related U.S. Application Data

(60) Provisional application No. 60/110,642, filed on Dec. 1, 1998.

(51) Int. Cl.[7] ..... A47G 25/14
(52) U.S. Cl. ..... 223/98
(58) Field of Search ..... 223/98, 87, 94, 223/89, 85, 88

(56) References Cited

U.S. PATENT DOCUMENTS 1,764,427 * 6/1930 Unker et al. ..... 223/98
2,042,846 * 6/1936 Hoffman ..... 223/98
2,813,668 * 11/1957 Griffis ..... 223/98
2,884,171 * 4/1959 Knuth ..... 223/98
5,390,835 * 2/1995 Murphy et al. ..... 223/87
5,718,362 * 2/1998 Silverman ..... 223/98

* cited by examiner

*Primary Examiner*—Bibhu Mohanty
(74) *Attorney, Agent, or Firm*—Robert M. Sperry

(57) ABSTRACT

Improved clothes hanger adapters comprising a pair of spreader means joined by connector means which are adjustable to fit a conventional wire clothes hanger to accurately fit a variety of sizes of clothing and to enable the user to hang related items, such as neckties, suspenders, belts and the like on the hanger along with the clothing items.

29 Claims, 8 Drawing Sheets

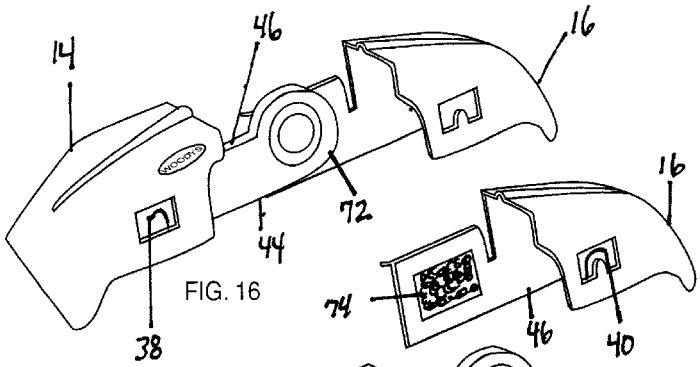
FIG. 16
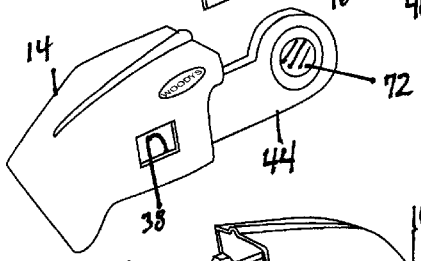
FIG. 17
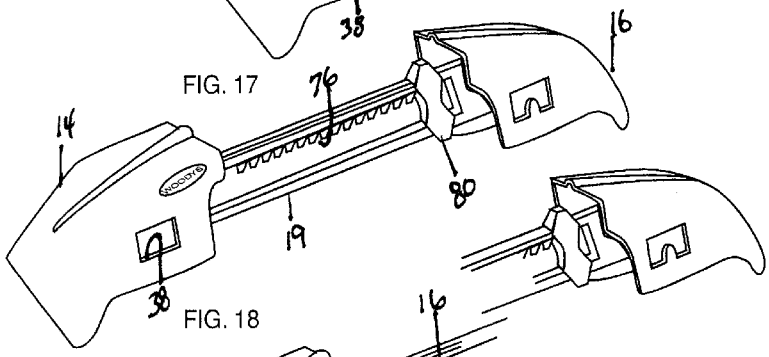
FIG. 18
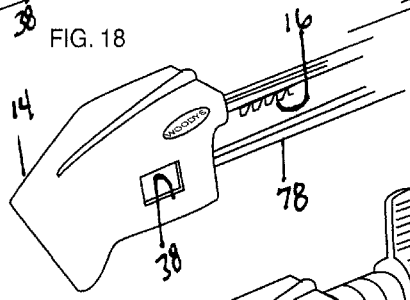
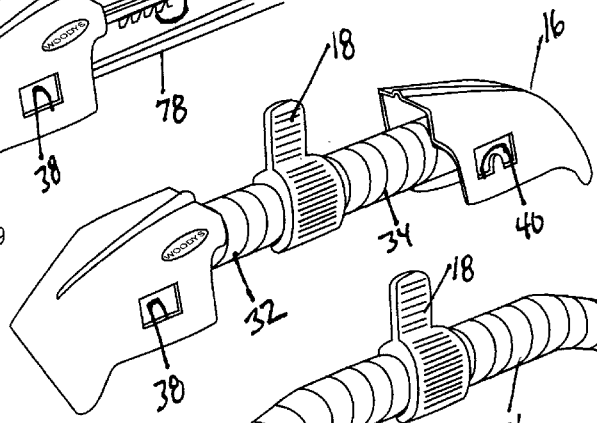
FIG. 19
FIG. 20
FIG. 21

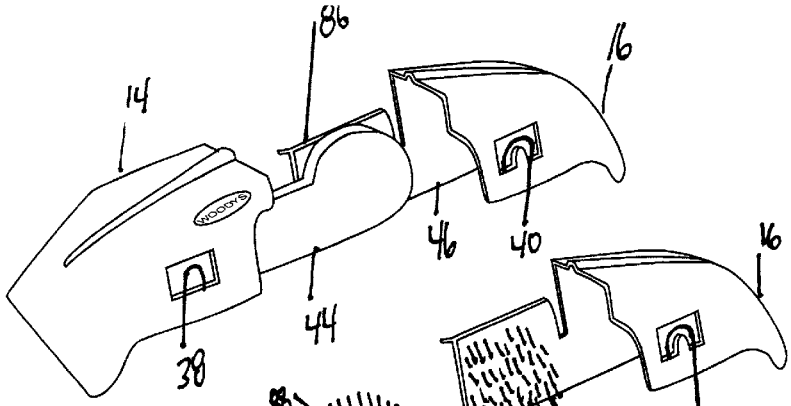
FIG. 22
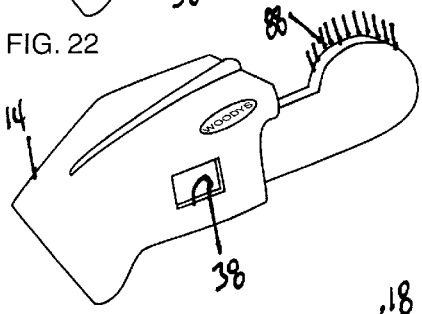
FIG. 23
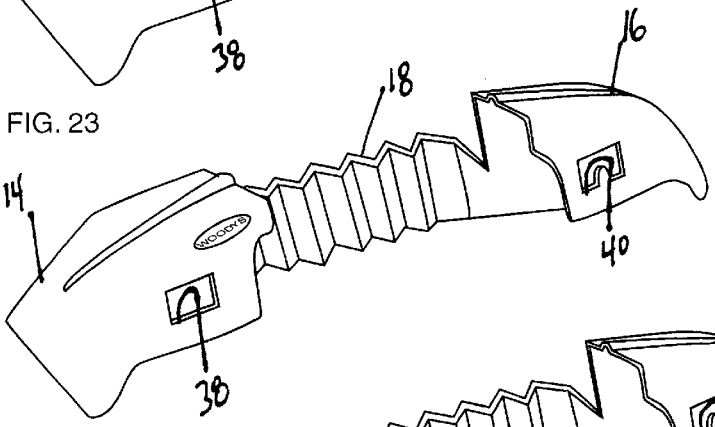
FIG. 24
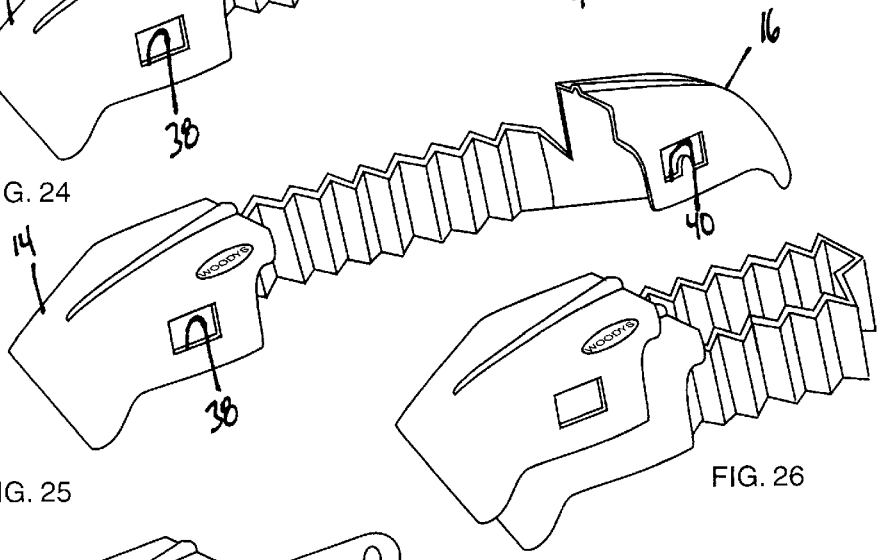
FIG. 25
FIG. 26
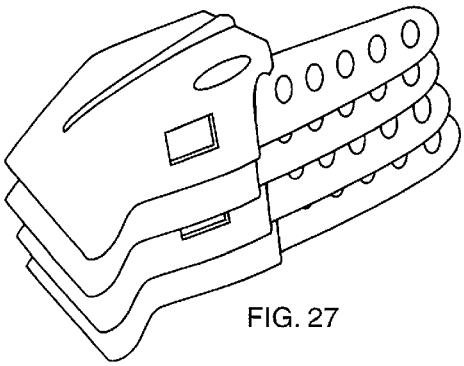
FIG. 27

CLOTHES HANGER ADAPTER

RELATED CASES

This invention is disclosed in my copemding Provisional patent application Ser. No. 60/110,642, filed Dec. 1, 1998

FIELD OF INVENTION

This invention relates to clothes hangers and is particularly directed to adapter means for making clothes hangers more suitable for heavy items, such as suits, dresses and the like.

PRIOR ART

Clothes hangers have long been used to facilitate storing clothing, such as suits, dresses and the like, in closets and other storage facilities. However, most clothes hangers are formed of relatively thin wire and are provided in a "one-size-fits-all" form which does not, in fact fit all sizes. Consequently, heavy clothes, such as men's suits, tend to deform the hangers, due to their weight, and sometimes result in the hanger collapsing and dropping the clothing on the floor. Alternatively, the weight of the clothing causes the hangers to form undesired and unsightly creases and lines in the clothing, which often do not shake out and, hence, mar the appearance of the clothing. Wooden, plastic of formed metal hangers can reduce these problems, but often fail to do so and are relatively expensive. Adapter devices have been proposed heretofore to overcome these problems. However, most of the prior art hanger adapters have been expensive to purchase or have been complex and difficult to install and use. Thus, none of the prior art clothes hanger adapters have been entirely satisfactory.

BRIEF SUMMARY AND OBJECTS OF INVENTION

These disadvantages of the prior art are overcome with the present invention and improved clothes hanger adapters are provided which are inexpensive to produce and purchase and which are simple and easy to install and use, yet which avoid the problems of conventional wire clothes hangers and which allow the hanger to be adapted to fit a wide variety of sizes and styles of clothing and to be used with a wide variety of types of clothes hangers.

These advantages of the present invention are preferably attained by providing improved clothes hanger adapters comprising a pair of spreader means joined by connector means which are adjustable to fit a conventional wire clothes hanger to accurately fit a variety of sizes of clothing and to enable the user to hang related items, such as neckties, suspenders, belts and the like on the hanger along with the clothing items.

Accordingly, it is an object of the present invention to provide improved adapters for clothes hangers.

Another object of the present invention is to provide improved adapters for wire clothes hangers.

An additional object of the present invention is to provide improved adapters for clothes hangers which are inexpensive to produce and purchase.

A further object of the present invention is to provide improved adapters for clothes hangers which are simple to install and use.

Another object of the present invention is to provide improved adapters for clothes hangers which prevent the wire hanger from creasing the clothing.

An additional object of the present invention is to provide improved adapters for clothes hangers which are adjustable to accurately fit a wide variety of clothing sizes.

A further object of the present invention is to provide improved adapters for clothes hangers which enable the user to store accessory items, such as neckties, suspenders, belts and the like on the hanger together with the related clothing items.

Another object of the present invention is to provide improved adapters for use with a wide variety of types of clothes hangers.

A specific object of the present invention is to provide improved clothes hanger adapters comprising a pair of spreader means joined by connector means which are adjustable to fit a conventional wire clothes hanger to accurately fit a variety of sizes of clothing and to enable the user to hang related items, such as neckties, suspenders, belts and the like on the hanger along with the clothing items.

These and other objects and features of the present invention will be apparent from the following detailed description, taken with reference to the figures of the accompanying drawing.

BRIEF DESCRIPTION OF THE DRAWING

FIG. 16 is a front view of an additional alternative form of the adapter of FIG. 1;

FIG. 17 is an exploded view of the adapter of FIG. 16;

FIG. 18 is a front view of another alternative form of the adapter of FIG. 1;

FIG. 19 is an exploded view of the adapter of FIG. 18;

FIG. 20 is a front view of a further alternative form of the present invention;

FIG. 21 is a view, similar to that of FIG. 20, showing the adapter of FIG. 20 in its expanded position;

FIG. 22 is a front view of another alternative form of the adapter of FIG. 1;

FIG. 23 is an exploded view of the adapter of FIG. 22;

FIG. 24 is a front view of a further alternative form of the adapter of FIG. 1;

FIG. 25 is a view, similar to that of FIG. 24, showing the adapter of FIG. 24 in the expanded position;

FIG. 26 is a front view showing the adapter of FIG. 24 folded for convenient storage;

FIG. 27 is a front view showing a plurality of shoulder pieces of the adapter of FIG. 1 nested for convenient storage;

DETAILED DESCRIPTION OF THE INVENTION

Figure 1:
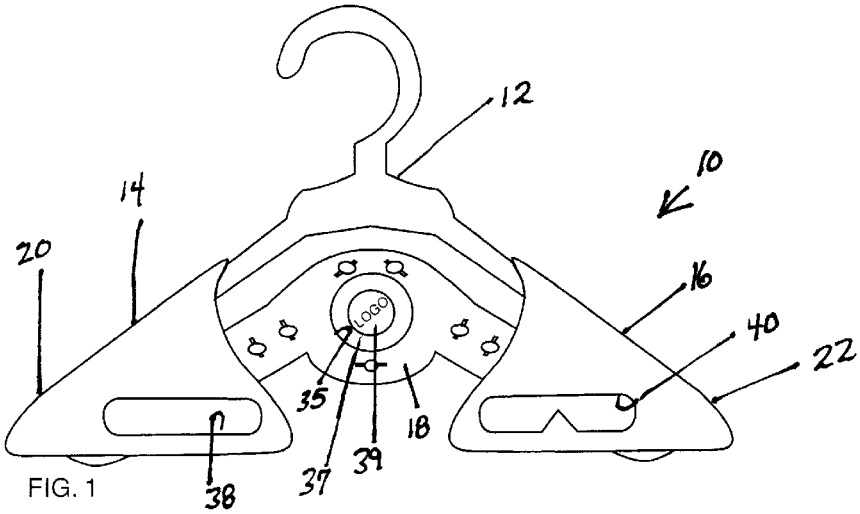
FIG. 1 Is a front elevation showing an adapter embodying the present invention mounted on a wooden clothes hanger.
Figure 2:
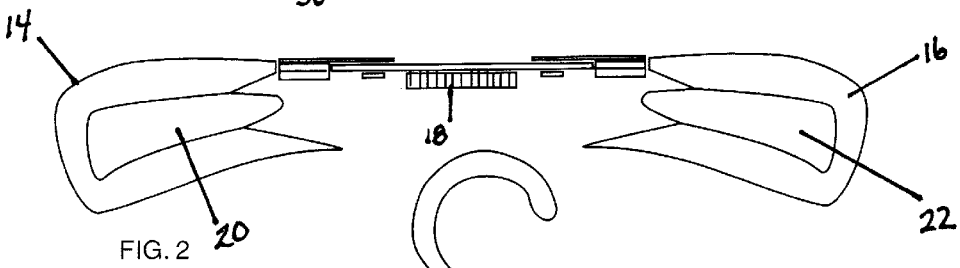
FIG. 2 is a plan view of the adapter of FIG. 1.
Figure 3:
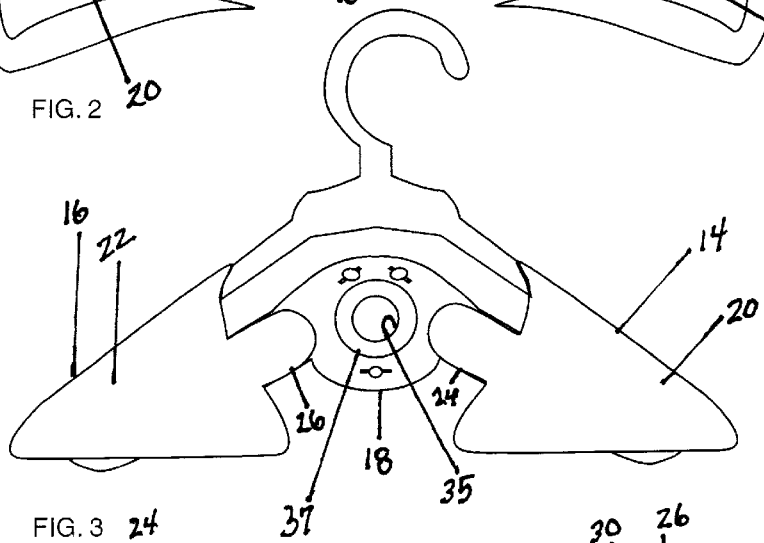
FIG. 3 is a rear view of the adapter of FIG. 1.
Figure 4:
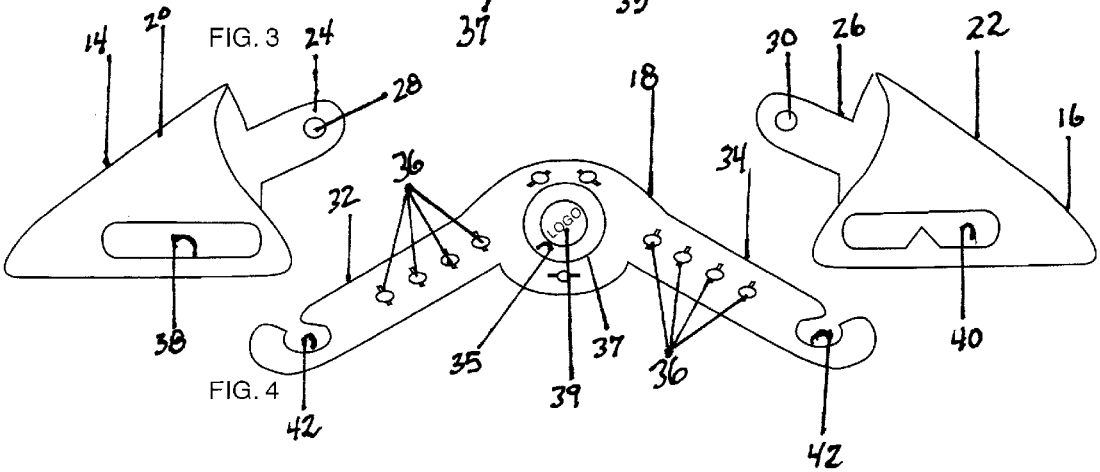
FIG. 4 is an exploded view of the adapter of FIG. 1.

In that form of the present invention chosen for purposes of illustration, FIG. 1 shows a clothes hanger adapter, indicated generally at 10, mounted on a wooden or plastic clothes hanger 12. As shown, the adapter 10 comprises a pair of shoulder pieces 14 and 16 joined by a connecting member 18 which enables the shoulder pieces 14 and 16 to be adjustably positioned to accurately fit a wide variety of clothing. As best seen in FIG. 2, the shoulder pieces 14 and 16 have wide upper surfaces 20 and 22 which serve to support an article of clothing out of contact with the hanger 12 and to distribute the load of the article of clothing to prevent unsightly creases from being formed in the article of clothing by the hanger 12. As best seen in FIG. 4, the adapter 10 comprises a pair of shoulder pieces 14 and 16 having relatively wide upper surfaces 20 and 22 and having inwardly extending projections 24 and 26 formed with studs 28 and 30. The connecting member 18 is formed with a pair of arms 32 and 34 each having a plurality of openings 36 to receive the studs 28 and 30 of the shoulder pieces 14 and 16 and to allow the shoulder pieces 14 and 16 to be adjustably positioned on the connecting member 18 to accurately fit a wide variety of clothing sizes. Also, the shoulder pieces 14 and 16 are formed with openings 38 and 40 to enable the user to hang accessory items, such as belts, suspenders, neckties and the like on the shoulder pieces 14 and 16 or a net bag, as seen at 33, for holding articles, such as bow ties and the like. In addition, the arms 32 and 34 of the connecting member 18 are formed with recesses 42 to enable ladies to hang dresses having straps or the like on the adapter 10. If desired, the connecting member 18 may be formed with a hollow cup-like projection 35 having a removable cap 37. The cup-like projection 35 serves to retain loose articles, such as cuff links, tie tacks and the like, and the cap 37 serves to retain the articles in the cup-like projection 35, yet is removable, at will, to provide access to these articles. Obviously, the cap 37 may carry a trademark, logo or decorative material, as seen at 39.

Figure 5:
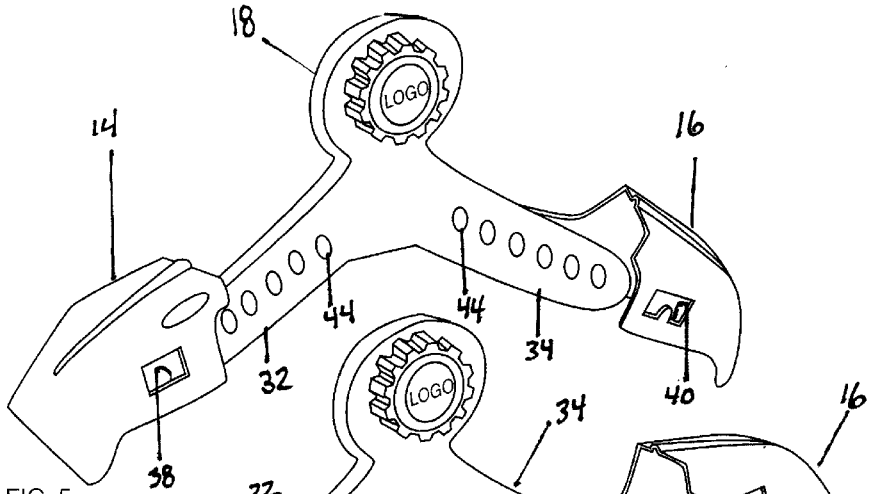
FIG. 5 is a front view of an alternative form of the adapter of FIG. 1.
Figure 6:
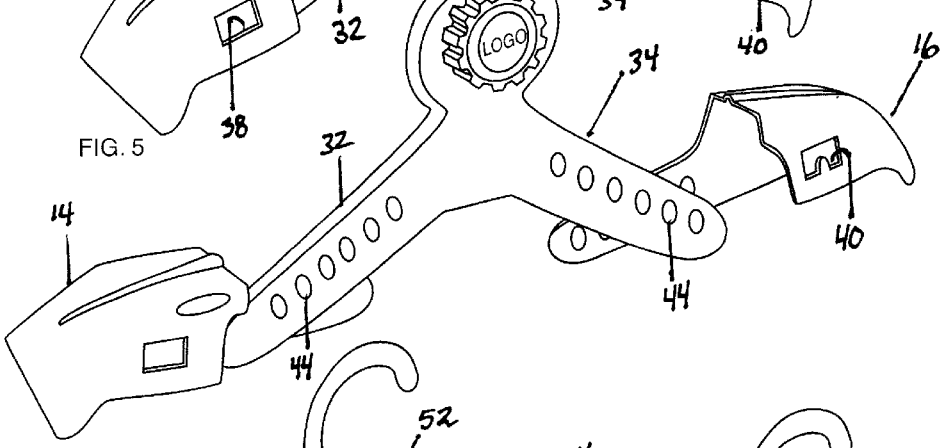
FIG. 6 is a view, similar to that of FIG. 5, showing the adapter of FIG. 5 in an expanded position.

FIG. 5 shows an alternative form of the adapter 10 wherein the shoulder pieces 14 and 16 are releasably attached to the connecting member 18 by means of bolts 44 which project through the openings 36 of arms 32 and 34 of the connecting member 28 and through suitable openings formed in projections 24 and 26 of the shoulder pieces to engage suitable nuts, not shown. As seen in FIG. 6, by extending the bolts 44 through appropriate ones of the openings 36 of arms 32 and 34 of the connecting member 18, the positions of the shoulder pieces 14 and 16 may be adjusted with respect to the connecting member 18 to accurately accommodate a wide variety of clothing sizes.

Figure 7:
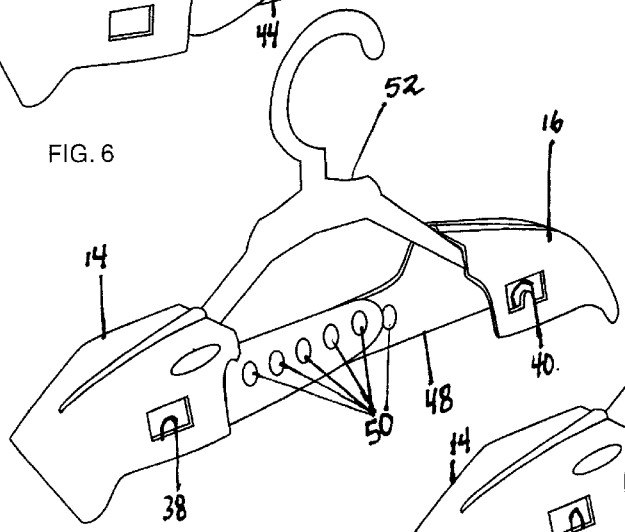
FIG. 7 is a front view showing another alternative form of the adapter of FIG. 1 mounted on a plastic clothes hanger.
Figure 8:
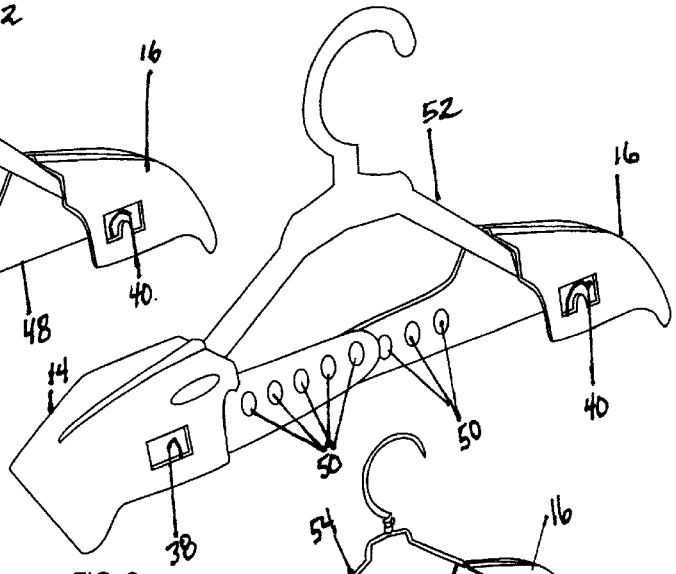
FIG. 8 is a front view showing the adjustability of the adapter of FIG. 7.
Figure 9:
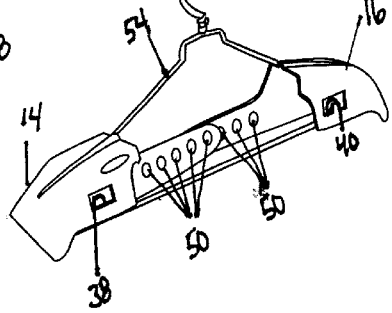
FIG. 9 is a view, similar to that of FIG. 7 showing the adapter of FIG. 7 mounted on a wire clothes hanger.

FIG. 7 shows another alternative form of the adapter 10 wherein the shoulder pieces 14 and 16 are formed with inwardly projecting arms 46 and 48 each formed with a plurality of openings 50. Studs 26 and 28 carried adjacent the ends of the arms 46 and 48 are insertable through the openings 50 of the opposite shoulder piece 14 or 16 to releasably connect the shoulder pieces 14 and 16 together to form the adapter 10. FIGS. 7 and 8 show this form of the adapter 10 mounted on plastic hangers 52, while FIG. 9 shows this form of the adapter mounted on a wire hanger 54.

Figure 10:
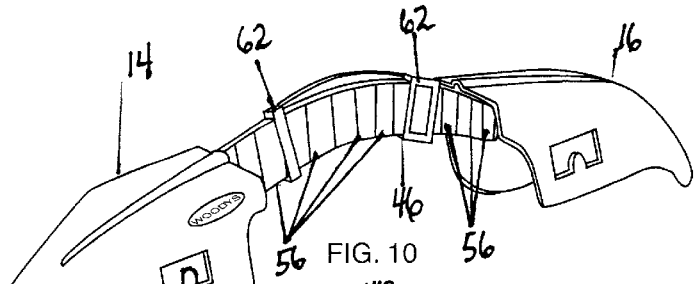
FIG. 10 is a front view of another alternative form of the adapter of FIG. 1.
Figure 11:
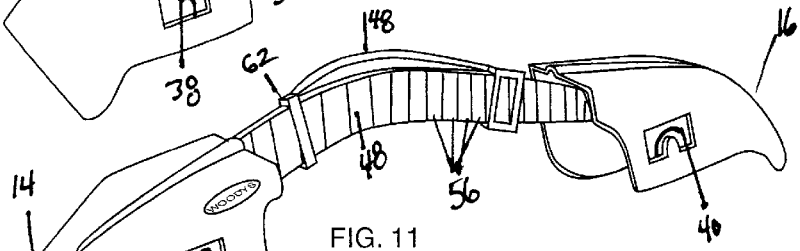
FIG. 11 is a view, similar to that of FIG. 10, showing the adapter in its expanded position.

FIG. 10 shows another alternative form of the adapter 10 wherein the arm 46 of shoulder piece 14 is formed with a plurality of ridges 56 and arm 48 carries a ratchet-type member 58 which is slideable along arm 46 and has a resilient lever 60 which, when depressed, allows arm 48 to slide along arm 46, yet which, when released, retains arm 48 in a desired position along arm 46. Guide loop 62, carried by arm 48, serves to prevent separation of the arms 46 and 48.

Figure 12:
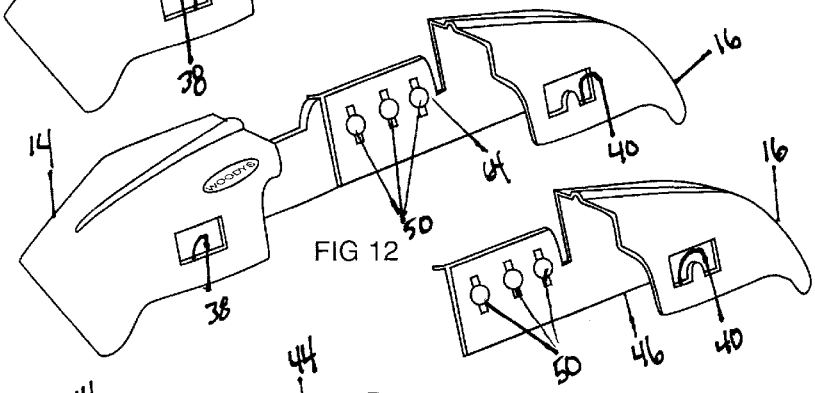
FIG. 12 is a front view of yet another alternative form of the adapter of FIG. 1.
Figure 13:
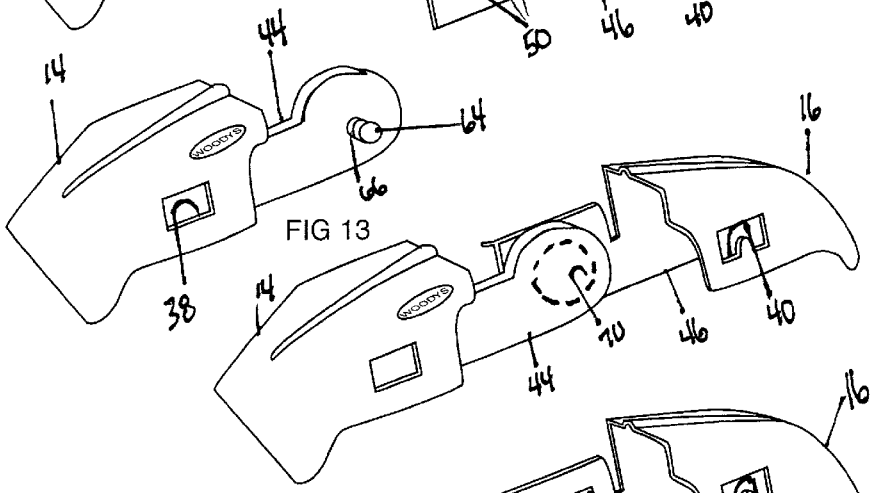
FIG. 13 is an exploded view of the adapter of FIG. 12.

FIG. 12 shows an additional alternative form of the adapter 10 wherein stud 28 of arm 44 is replaced by a screw 64 which is insertable through the openings 50 of arm 46 and engages threaded opening 66 of arm 44 to releasably attach the arms 14 and 16 together.

Figure 14:
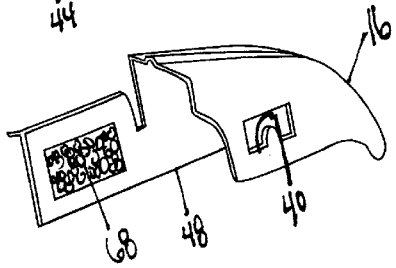
FIG. 14 is a front view of still another alternative form of the adapter of FIG. 1.
Figure 15:
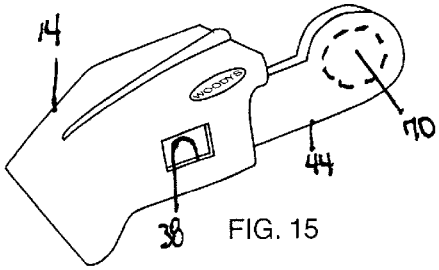
FIG. 15 is an exploded view of the adapter of FIG. 14.

FIG. 14 shows a further alternative form of the adapter 10 wherein the arms 44 and 46 of shoulder pieces 14 and 16 are provided with patches of hook-and-loop material 68 and 70 on their facing surfaces which are engageable to releasably connect the shoulder pieces 14 and 16 together to form the adapter 10.

FIGS. 16 and 17 show another alternative form of the adapter 10 wherein magnets 72 and 74 are mounted on the facing surfaces of arms 44 and 46 to releasably connect the shoulder pieces 14 and 16 to form the adapter 10.

FIGS. 18 and 19 show an additional alternative form of the adapter 10 wherein arms 44 and 46 of the shoulder pieces 14 and 16 are removed and shoulder piece 14 is provided with a ratcheted arm 76 and a guide arm 78 which are engageable by a retainer member 80 carried by shoulder piece 16 to releasably connect the shoulder pieces 14 and 16 together to form the adapter 10.

FIGS. 20 and 21 show another alternative form of the adapter 10 wherein the arms 32 and 34 of connecting member 18 are externally threaded and are received by internally threaded bosses 82 and 84 carried by shoulder pieces 14 and 16, respectively.

FIGS. 22 and 23 show an additional alternative form of the adapter 10 wherein arms 44 and 46 of the shoulder pieces 14 and 16 are provided with a plurality of relatively rigid hair-like projections 86 and 88 which are engageable to releasably connect the shoulder pieces 14 and 16 to form the adapter 10.

FIGS. 24–26 show an additional alternative form of the adapter 10 wherein connecting member 18 is formed accordion-like and joins the shoulder pieces 14 and 16 in an expandable fashion to form the adapter 10. As seen in FIG. 26, with this form of the adapter 10, the shoulder pieces 14 and 16 can be folded together to nest into each other for convenient storage.

FIG. 27 shows a plurality of adapters 10, of the type seen in FIGS. 7–9 shown nested for convenient storage.

Figure 30:
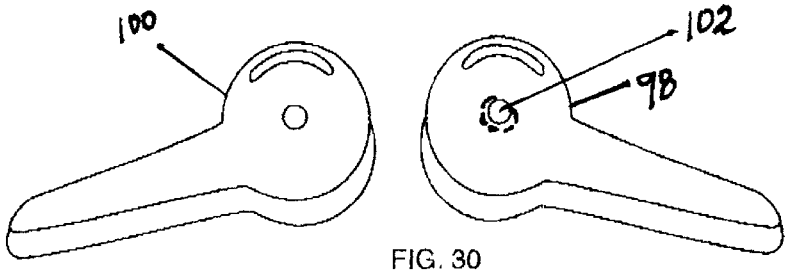
FIG. 30 is an exploded view of the center member of the adapter of FIG. 28.
Figure 29:
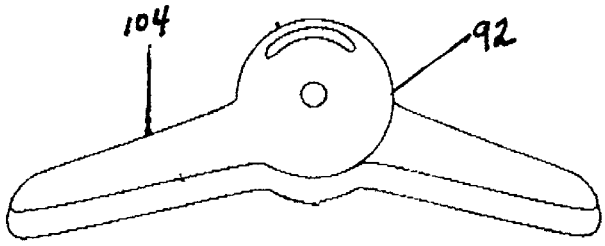
FIG. 29 is an exploded view of the adapter of FIG. 28.
Figure 29:
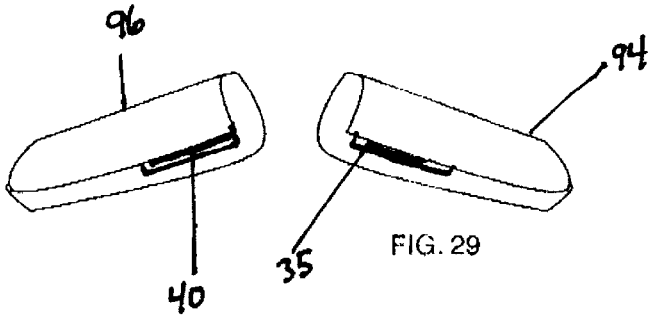
Figure 28:
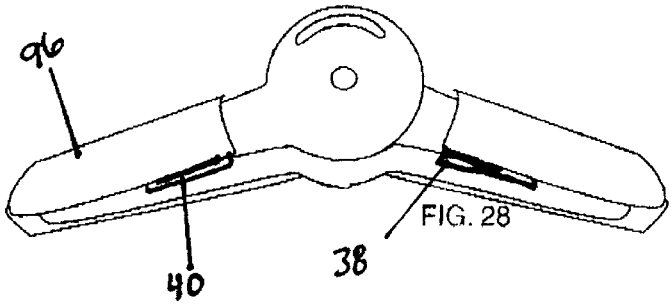
FIG. 28 is a front view showing another alternative form of the adapter of FIG. 1.
Figure 31:
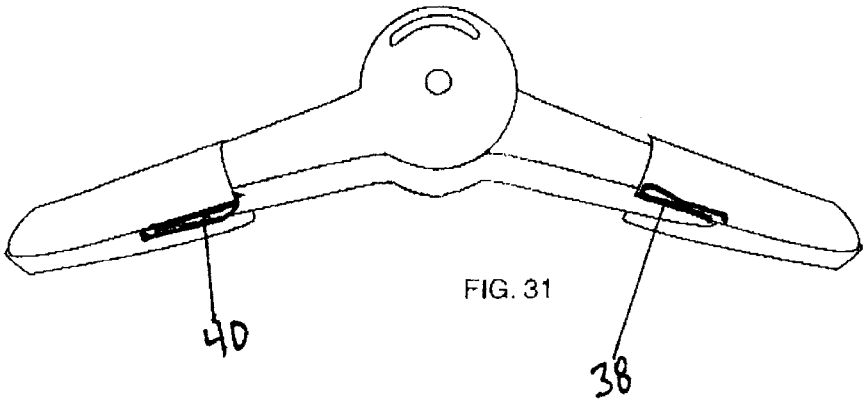
FIG. 31 is a front view showing the adapter of FIG. 28 with the shoulder pieces in the extended position.
Figure 32:
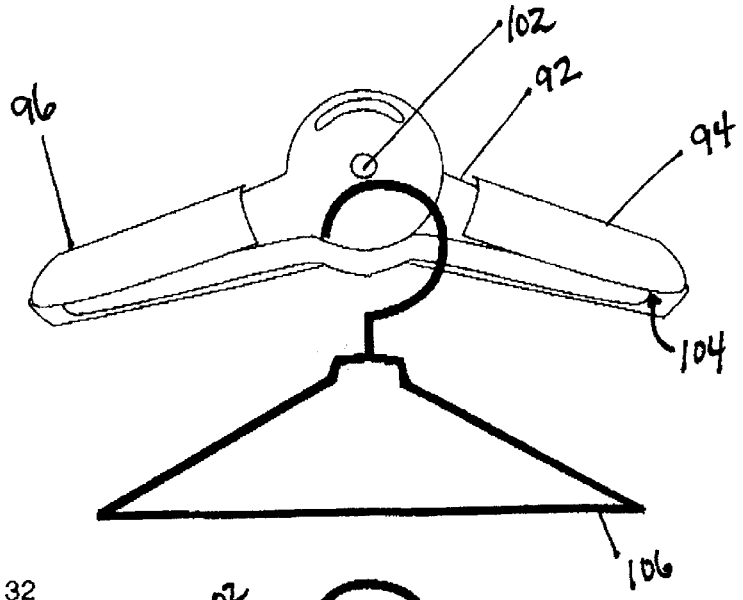
FIG. 32 is a front view of the adapter of FIG. 28 showing a hanger being inserted into the adapter.
Figure 33:
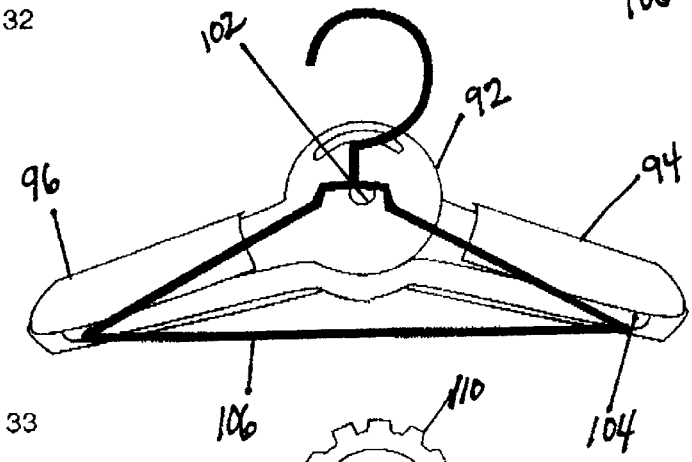
FIG. 33 is a front view of the adapter of FIG. 28 showing the hanger fully inserted into the adapter.
Figure 36:
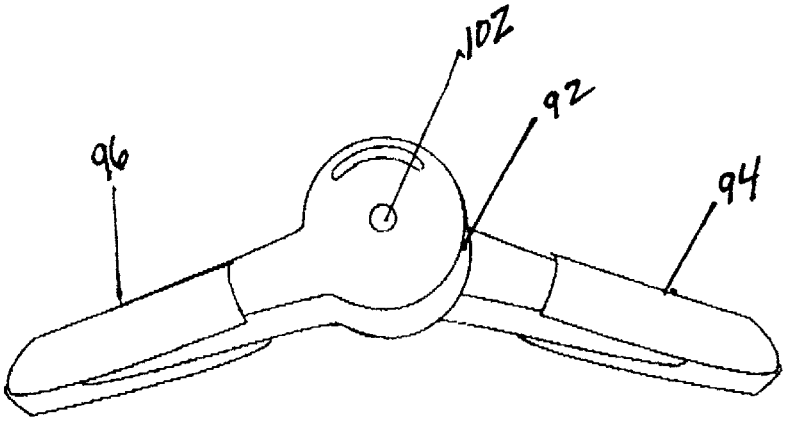
FIG. 36 is a front view showing the adapter of FIG. 28 being folded for storage.
Figure 36:
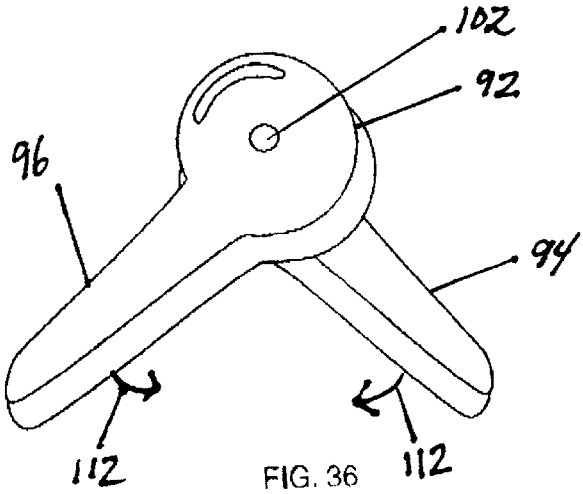
Figure 37:
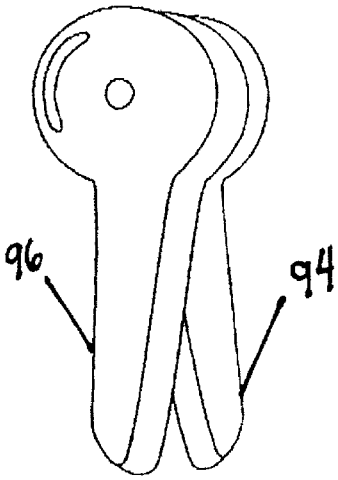
FIG. 37 is a front view of the adapter of FIG. 28, shown in the fully folded position.

FIG. 28 shows an alternative form of the adapter 10, indicated generally at 90, comprising a connecting member 92 with shoulder pieces 94 and 96. The connecting member 92 may be formed as a single unit, as seen in FIG. 29, or may be formed by a pair of members 98 and 100, hingedly joined by a screw 102 or the like, as seen in FIG. 30. As seen in FIGS. 36 and 37, screw 102 may be loosened and members 98 and 100 may be swung toward each other, as indicated by arrows 112, to collapse the adapter 90 for storage in a minimum amount of space. The shoulder pieces 94 and 96 have a frictional fit with the connecting member 92 to enable the shoulder pieces 94 and 96 to be adjustably positioned along the connecting member 92, as seen in FIGS. 28 and 31. Also, the shoulder pieces 94 and 96 may, if desired, be provided with suitable openings 38 and 40, as described above with respect to FIG. 1, to retain belts, neckties and the like. The connecting member 92 and shoulder pieces 94 and 96 are generally U-shaped, having an open bottom 104, and a hanger 106 may be inserted through the open bottom 104 of the connecting member 92 and shoulder pieces 94 and 96, as seen in FIGS. 32 and 33.

Figure 34:
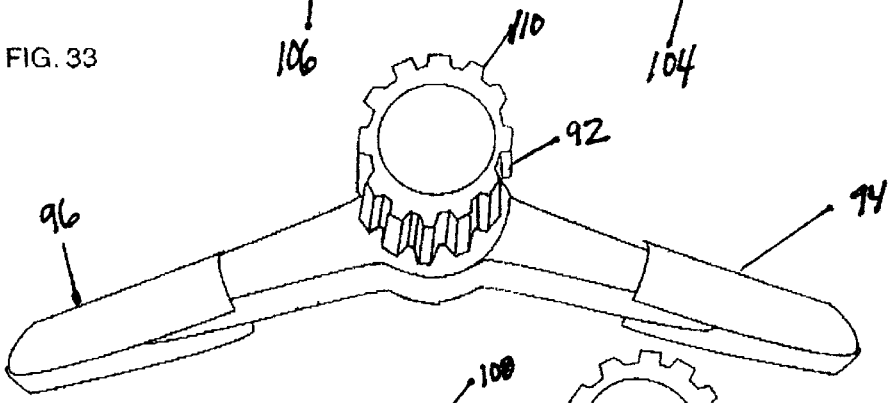
FIG. 34 is a front view of a further alternative form of the adapter of FIG. 1.
Figure 35:
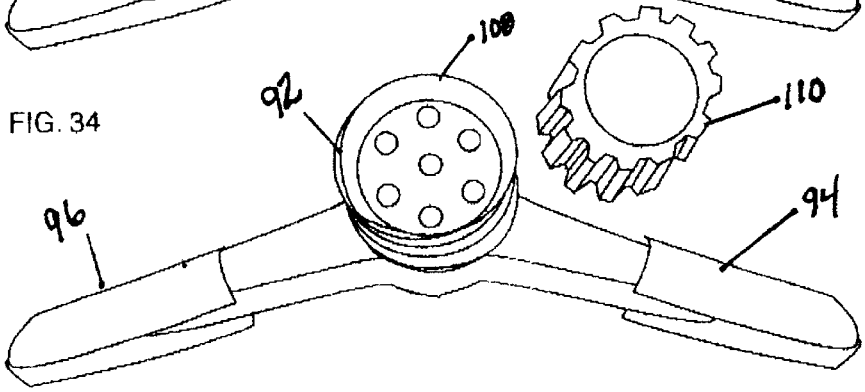
FIG. 35 is a view of the adapter of FIG. 34, shown with the central cap removed.

FIGS. 34 and 35 show an alternative form of the adapter of FIG. 28 having a generally cup-shaped container 108 formed on the connecting member 92 and having a releasable lid 110 which is frictionally engageable with the container 108 to retain loose articles, such as cuff links, tie tacks and the like.

Obviously numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. Adapters for clothes changers comprising:

a pair of spreader means joined by connector means which are adjustably connectable to fit a conventional clothes hanger to underlie and accurately fit a variety of sizes of clothing items and formed with means to enable the user to hang related items, such as neckties, suspenders, belts and the like on the hanger along with the clothing items.

2. The adapter of claim 1 wherein:

said connector means comprises arms projecting inward from said spreader means, and a central member having means releasably connectable with said arms to form said adapter.

3. The adapter of claim 2 wherein:

said central member is formed with a plurality of holes, and said arms each carry studs releasably insertable into the holes of said arms to connect said central member to said spreader means.

4. The adapter of claim 1 wherein:

each of said spreader means is formed with a wide upper surface to support clothing without causing wrinkles.

5. The adapter of claim 1 wherein:

said spreader means are formed with openings for releasably retaining elongated articles.

6. The adapter of claim 5 further comprising:

a net bag supported in at least one of said openings to releasably retain loose articles.

7. The adapter of claim 2 wherein:

said central member is formed with a cup-like projection having a removable cap for retaining loose articles.

8. The adapter of claim 7 wherein:

said cap carries a trademark.

9. The adapter of claim 2 wherein:

said connecting member is formed with recesses adjacent the ends thereof for supporting clothing by straps.

10. The adapter of claim 2 further comprising:

holes are formed in said arms and in said connecting member and threaded fastener means releasably connecting said shoulder pieces and said connecting member.

11. The adapter of claim 1 herein:

said spreader means are formed with inwardly projecting arms having releasable fastening means carried by said arms for connecting said spreader means together to form said adapter.

12. The adapter of claim 11 wherein:

said releasable fastening means are threaded fasteners.

13. The adapter of claim 11 wherein:

said releasable fastening means are patches of hook-and-loop material located on said arms.

14. The adapter of claim 11 wherein:

said releasable fastening means are magnets mounted on said arms.

15. The adapter of claim 2 wherein:

said arms are ratcheted and said connecting means carries a latch member which can be raised to allow sliding of said arms therethrough and can be depressed to lock said arms in a desired location.

16. The adapter of claim 11 wherein:

one of said arms is ratcheted, and the other of said arms carries a latch member which can be raised to allow sliding of said one arm therethrough and can be depressed to lock said arms in a desired location.

17. The adapter of claim 11 wherein:

said arms carry releasable fastening means for releasably connecting said spreader members.

18. The adapter of claim 17 wherein:

said releasable fastening means are threaded fasteners.

19. The adapter of claim 18 wherein:

said releasable fastening means are patches of hook-and-loop material.

20. The adapter of claim 18 wherein:

said releasable fastening means are magnets.

21. The adapter of claim 11 wherein:

one of said arms is ratcheted, and the other of said arms is formed with a retainer to releasably retain said ratcheted arm.

22. The adapter of claim 2 wherein:

said arms are externally threaded and said connecting member is internally threaded.

23. The adapter of claim 11 wherein:

each of said arms carries patches of relatively rigid hair-like members which are engageable with similar members carried by the other arm to releasably connect said spreaders.

24. The adapter of claim 2 wherein:

said connecting member is folded accordion-style to enable said spreaders to be adjustably separated.

25. The adapter of claim 24 wherein:

said connecting member can be folded on itself to allow said spreaders to be nested for storage.

26. The adapter of claim 1 wherein:

said spreaders can be nested for storage.

27. The adapter of claim 11 wherein:

said spreaders can be nested for storage.

28. The adapter of claim 1 wherein:

said connecting means is formed of a pair of hingedly joined members which can be folded toward each other for storage in a minimal space.

29. The adapter of claim 28 wherein:

said hingedly joined members are formed generally U-shaped having an open lower surface to allow insertion of a hanger therethrough.

* * * * *